US008719991B2

(12) United States Patent
Berti et al.

(10) Patent No.: US 8,719,991 B2
(45) Date of Patent: May 13, 2014

(54) CLEANING IMPLEMENT

(71) Applicant: The Libman Company, Arcola, IL (US)

(72) Inventors: Enzo Berti, Pianiga (IT); Roberto Pellacini, Torrechiara Langhirano (IT)

(73) Assignee: The Libman Company, Arcola, IL (US)

( * ) Notice: Subject to any disclaimer, the term of this patent is extended or adjusted under 35 U.S.C. 154(b) by 0 days.

(21) Appl. No.: 13/850,274

(22) Filed: Mar. 25, 2013

(65) Prior Publication Data

US 2013/0247318 A1 Sep. 26, 2013

Related U.S. Application Data

(60) Division of application No. 13/041,267, filed on Mar. 4, 2011, now Pat. No. 8,402,589, which is a continuation-in-part of application No. 29/383,177, filed on Jan. 13, 2011, now Pat. No. Des. 660,534, and a continuation-in-part of application No. 12/401,336, filed on Mar. 10, 2009, now Pat. No. 7,921,498, which is a continuation of application No. 11/189,127, filed on Jul. 25, 2005, now Pat. No. 7,520,018, which is a continuation-in-part of application No. 10/356,896, filed on Feb. 3, 2003, now Pat. No. 6,920,664, which is a continuation-in-part of application No. 29/145,583, filed on Jul. 25, 2001, now Pat. No. Des. 474,869.

(51) Int. Cl.

| | |
|---|---|
| ***A47L 13/14*** | (2006.01) |
| ***A47L 13/142*** | (2006.01) |
| ***A47L 13/20*** | (2006.01) |

(52) U.S. Cl.

USPC ..... 15/120.1; 15/119.1; 15/147.1; 15/229.2

(58) Field of Classification Search

USPC ..... 15/116.1, 119.1, 120.1, 120.2, 147.1, 15/228, 229.1, 229.2

See application file for complete search history.

(56) References Cited

U.S. PATENT DOCUMENTS

| | | | |
|---|---|---|---|
| 957,025 | A | 5/1910 | Zachry |
| 1,073,612 | A | 9/1913 | Lockhart |

(Continued)

FOREIGN PATENT DOCUMENTS

| | | |
|---|---|---|
| DE | 3607121 | 9/1987 |
| DE | 10235307 | 2/2004 |

(Continued)

OTHER PUBLICATIONS http://www.ocedar.com/main.taf?erube_fh=ocedar&ocedar.submit.getProductDetails=1&ocedar.productid=23, last accessed Mar. 3, 2011.

(Continued)

*Primary Examiner* — Mark Spisich

(74) *Attorney, Agent, or Firm* — Banner & Witcoff, Ltd.

(57) ABSTRACT

Novel cleaning implements and novel components of cleaning implements are provided. Aspects relate to novel wringers having convex regions with a plurality of drain exits. In some embodiments, concave regions are also provided. The concave regions are substantially devoid of any drain exits. An upper portion of the wringer may be substantially cylindrical or conic-cylindrical and a lower portion may be neither cylindrical nor conic-cylindrical. The bottom perimeter of the bottom may define a square-like shape. Further aspects relate to novel connection assemblies. Certain assemblies may have a top portion with a vertical wall that is configured to position mop fibers along a vertical axis.

9 Claims, 14 Drawing Sheets

(56) References Cited

U.S. PATENT DOCUMENTS

| | | | | |
|---|---|---|---|---|
| 1,138,922 | A | | 5/1915 | Allen |
| 1,273,768 | A | | 7/1918 | Gillam |
| 1,709,622 | A | | 4/1923 | Justis |
| 1,473,563 | A | | 11/1923 | Julson |
| 1,557,894 | A | | 10/1925 | Sturgis |
| 2,905,958 | A | * | 9/1959 | Sannes ..... 15/229.2 |
| 3,364,512 | A | | 1/1968 | Yamashita et al. |
| 3,462,788 | A | | 8/1969 | Abbott |
| 3,946,457 | A | | 3/1976 | Robinson |
| 4,593,430 | A | | 6/1986 | Spangler et al. |
| 4,809,287 | A | | 2/1989 | Ohba et al. |
| 5,060,338 | A | | 10/1991 | Yates et al. |
| 5,509,163 | A | | 4/1996 | Morad |
| 5,577,290 | A | | 11/1996 | Monahan |
| 5,581,839 | A | | 12/1996 | Ferrell, Jr. |
| 5,615,442 | A | | 4/1997 | Schroeck et al. |
| 5,642,551 | A | | 7/1997 | Cann et al. |
| 5,675,857 | A | | 10/1997 | Hirse |
| D387,526 | S | | 12/1997 | Berti et al. |
| D387,527 | S | | 12/1997 | Specht |
| 5,724,694 | A | | 3/1998 | Lewis |
| 5,727,281 | A | | 3/1998 | Harper |
| 5,819,356 | A | | 10/1998 | Cann |
| 5,842,810 | A | | 12/1998 | Morad |
| 5,875,509 | A | | 3/1999 | Facca |
| 5,976,266 | A | | 11/1999 | Anderson et al. |
| 5,996,161 | A | | 12/1999 | Facca |
| 6,006,392 | A | | 12/1999 | Seculov et al. |
| 6,058,549 | A | | 5/2000 | Milward-Bason |
| 6,085,378 | A | | 7/2000 | Petner |
| 6,088,867 | A | | 7/2000 | Stefani et al. |
| 6,108,848 | A | | 8/2000 | Monahan |
| 6,115,869 | A | | 9/2000 | Libman |
| 6,125,494 | A | | 10/2000 | Morad |
| 6,212,727 | B1 | | 4/2001 | Bendor |
| 6,212,728 | B1 | | 4/2001 | Facca et al. |
| 6,427,280 | B1 | | 8/2002 | Specht |
| 6,477,731 | B2 | | 11/2002 | Monahan |
| 6,625,838 | B2 | | 9/2003 | Laux et al. |
| RE38,380 | E | | 1/2004 | Libman et al. |
| 6,732,396 | B2 | | 5/2004 | Laux et al. |
| 6,745,429 | B2 | | 6/2004 | Ng |
| 6,941,608 | B1 | | 9/2005 | Morad et al. |
| 7,065,823 | B2 | | 6/2006 | Llanes |
| 7,089,622 | B2 | | 8/2006 | Sampaio |
| 7,093,315 | B2 | | 8/2006 | Cavalheiro |
| 7,260,865 | B2 | | 8/2007 | Lesley et al. |
| 7,640,616 | B2 | | 1/2010 | Peterson |
| 7,891,039 | B2 | | 2/2011 | Lin |
| 2002/0092105 | A1 | | 7/2002 | Laux et al. |
| 2002/0108197 | A1 | | 8/2002 | Specht |
| 2002/0116780 | A1 | | 8/2002 | Young |
| 2002/0133892 | A1 | | 9/2002 | Monahan |
| 2003/0213079 | A1 | | 11/2003 | Libman et al. |
| 2004/0128783 | A1 | | 7/2004 | Lesley et al. |
| 2005/0022327 | A1 | | 2/2005 | Cavalheiro |
| 2006/0016031 | A1 | | 1/2006 | Llanes |
| 2006/0016032 | A1 | | 1/2006 | Libman et al. |
| 2006/0021171 | A1 | | 2/2006 | Niccolai |
| 2006/0026785 | A1 | | 2/2006 | Sampaio |
| 2006/0150353 | A1 | | 7/2006 | Cavalheiro |
| 2006/0225234 | A1 | | 10/2006 | Petner |
| 2007/0143941 | A1 | | 6/2007 | Shih |
| 2007/0151057 | A1 | | 7/2007 | Petner et al. |
| 2007/0186363 | A1 | | 8/2007 | Chiang |
| 2007/0226929 | A1 | | 10/2007 | Kao |
| 2007/0277337 | A1 | | 12/2007 | Bizzotto |
| 2008/0010768 | A1 | | 1/2008 | Lesley |
| 2008/0092315 | A1 | | 4/2008 | Lin |
| 2009/0025163 | A1 | | 1/2009 | Specht et al. |
| 2009/0165231 | A1 | | 7/2009 | Libman et al. |
| 2009/0165232 | A1 | | 7/2009 | Libman |
| 2009/0260169 | A1 | | 10/2009 | Chen |
| 2009/0307855 | A1 | | 12/2009 | Kao |
| 2010/0218327 | A1 | | 9/2010 | Chen |

FOREIGN PATENT DOCUMENTS

| | | | |
|---|---|---|---|
| EP | 739600 | * | 10/1996 |
| EP | 1180341 | | 2/2002 |
| ES | 2117588 | | 8/1998 |
| FR | 2595234 | | 9/1987 |
| FR | 2873053 | | 1/2006 |
| FR | 2915074 | | 10/2008 |
| GB | 1586313 | | 3/1981 |
| JP | 5-199974 | * | 8/1993 |
| NL | 2000800 | | 2/2009 |
| WO | 9507046 | | 3/1995 |
| WO | 96/32048 | | 10/1996 |
| WO | 2004021851 | | 3/2004 |

OTHER PUBLICATIONS http://www.homedepot.com/h_d1/N-5yc1v/R-100535273/h_d2/ProductDisplay?langId=-1&storeId=10051&catalogId=10053, last accessed Mar. 3, 2011.

http://www.amazon.com/Mr-Clean-Express-Mop-1-30-Pound/dp/B003ZYM06U/ref=sr_1_219?s=hpc&ie=UTF8&qid=1298921011&sr=1-219, last accessed Mar. 3, 2011.

http://www.amazon.com/Leifheit-55401-Twister-Replacement-Head/dp/B002BU4EVI/ref=sr_1_164?s=hpc&ie=UTF8&qid=1298920716&sr=1-164, last accessed Mar. 3, 2011.

http://www.amazon.com/Quickie-Mfg-0911-Wringer-Refill/dp/B001D4J281/ref=sr_1_132?s=hpc&ie=UTF8&qid=1298920517&sr=1-132, last accessed Mar. 3, 2011.

http://www.amazon.com/Quickie-Twist-Refill-Mops-Cotton/dp/B000ASERBU/ref=sr_1_126?s=hpc&ie=UTF8&qid=1298920394&sr=1-126, last accessed Mar. 3, 2011.

http://www.amazon.com/Casabella-09529-Microfiber-String-Refill/dp/B001DVUYRE/ref=pd_sim_hi_1, last accessed Mar. 3, 2011.

http://www.amazon.com/Casabella-09452-Microfiber-String-Wring/dp/B0018HFOLO/ref=sr_1_116?s=hpc&ie=UTF8&qid=1298920082&sr=1-116, last accessed Mar. 3, 2011.

http://www.amazon.com/Leifheit-55400-Twister-Handled-Bucket/dp/B002BUBA8S/ref=sr_1_71?s=hpc&ie=UTF8&qid=1298919749&sr=1-71, last accessed Mar. 3, 2011.

http://www.roundeyesupply.com/ProductDetails.asp?ProductCode=DE423839&Click=882, last accessed Mar. 3, 2011.

http://www.amazon.com/O-Cedar-Frudenberg-120325-VILEDA/dp/BOOOBSY980/ref=pd_sbs_k_21, last accessed Mar. 3, 2011.

http://www.amazon.com/LIBMAN-CO-02001-WONDER-REFILL/dp/B001BBFLCO/ref=pd_sim_k_3, last accessed Mar. 3, 2011.

Examiner's Report dated Dec. 13, 2012 in related Australian Patent Application No. 2012201174 (4 pages).

Japanese Patent Application No. 2012-041871 English translation of Office Action dated Jul. 31, 2013.

European Patent Application No. 12157849.6 Partial EP European Search Report dated Aug. 1, 2013.

* cited by examiner

CLEANING IMPLEMENT

This application is a divisional of U.S. patent application Ser. No. 13/041,267, filed Mar. 4, 2011, now U.S. Pat. No. 8,402,589 which claims priority to U.S. Design patent application Ser. No. 29/383,177 filed Jan. 13, 2011, now U.S. Pat. No. D660,534, and is a continuation-in-part U.S. Design patent application Ser. No. 29/383,177 filed Jan. 13, 2011, now U.S. Pat. No. D660,534, and is a continuation-in-part of U.S. patent application Ser. No. 12/401,336, filed Mar. 10, 2009, now U.S. Pat. No. 7,921,498, which is a continuation of U.S. patent application Ser. No. 11/189,127, filed Jul. 25, 2005, now U.S. Pat. No. 7,520,018, which is a continuation-in-part of application Ser. No. 10/356,896, filed on Feb. 3, 2003, now U.S. Pat. No. 6,920,664, which is a continuation-in-part of U.S. Application No. 29/145,583, filed on Jul. 25, 2001, now U.S. Pat. No. D474,869. U.S. patent application Ser. Nos. 13/041,267, 29/383,177, 12/401,336, 11/189,127, 10/356,896, 29/145,583 are each incorporated herein fully by reference.

BACKGROUND

One type of mop that has found commercial success is in the marketplace is a mop having an attached wringer cup, like the one disclosed in U.S. Pat. No. 5,060,338. Other examples may be found in U.S. Pat. Nos. 1,709,622; 3,364,512; 3,946,457; and 4,809,287; and German published patent Application No. DE 3607121 A1.

The wringer cups used on these kinds of mops often have grooves or ribs on the inside. When the cone-shaped wringer cup is pushed down over the mop fibers, the ribs help to squeeze water out of the mop fibers. The wringing is not always completely effective, however. Some of the water that has been squeezed out of the mop fibers can sometimes reenter the fibers before draining completely out of the wringer cup. Certain existing wringers and/or connection assemblies allow the mop fibers to become tangled or twisted in locations below other areas that are still retaining fluids, thereby preventing proper drainage of fluids. Other systems also may not properly orient the fibers to permit proper draining characteristics.

What is needed, therefore, are improved systems and methods that improve upon conventional devices and processes, including one or more of the above-referenced limitations.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this disclosure relate to an innovative wringer cup. In an embodiment the wringer cup has holes in it that may permit water to drain out of the wringer cup more quickly and effectively so as to help prevent re-absorption. In an embodiment the wringer cup includes inwardly directed ribs and the ribs include perforations to enhance the draining of water from the mop fibers.

In one embodiment, wringer cup may comprise a unitary body having an upper end and a lower end. The upper end may have a terminus having a first outer perimeter that is substantially circular and a first inner perimeter defining a central bore configured to permit passage of the elongate member into an inner portion of by unitary body. In certain embodiments, the lower end may have a terminus having a second outer perimeter. In some embodiments, the second outer-perimeter may not be either circular or oval. The second outer perimeter may also be larger than the first outer perimeter.

The unitary body, such as on the lower end, may include inward extending ribs. Each of the ribs may have a first side and a second side that converge to form a rib bottom. The inward-extending ribs may be devoid of any perforations. The unitary body may also have outward-extending ribs, such as located on the lower end. The outward-extending ribs may include a first side and a second side that converge to form a rib top. In certain embodiments, the rib sides of the outward extending ribs may be devoid of perforations. In some embodiments, the rib top comprises a plurality of perforations.

The plurality of outer ribs may define a square-like shape along a horizontal plane parallel with the first outer perimeter of the upper end of the wringer. In other embodiments, an upper end of the wringer may be substantially conic-cylindrical and devoid of any drainage exits and a lower end is conical but not cylindrical. The lower end may further include convex regions that define at least two opposing concave regions positioned between adjacent convex regions. The lower end may further have drainage exits located on each concave region. The drainage exits may be located on a pinnacle location of the convex regions most distant from the inner most portion of the concave regions. In certain embodiments, no more than a single drainage exit is provided on any given horizontal plane of each convex region.

Drainage exits may be vertically arranged in a parallel fashion along the vertical axis (i.e., height) of convex regions. In one embodiment, at least one drainage exit has a height that is about 25-30% of its length. The drainage exit may be at least about 1 centimeter away from the interior-most location of adjacent concave regions. Another drainage exit may have a height that is about 35-40% of its length and is at least about 2 centimeters away from the interior-most location of adjacent concave regions.

The winger may be configured such that when the plurality of fibers are fully retracted into the inner portion of wringer, an upper portion of the fibers may be located at least above the upper most drainage exit of the outward extending ribs and aligned in a vertical manner parallel to a vertical axis defined by the central bore A first compression force may cause an initial twisting of the mop fibers located proximate to the elongate handle before corresponding sections of the same fibers located at an intermediate section of the wringer and corresponding sections located at a lower section of the wringer proximate to the lower-most drainage exit. Fibers in the intermediate portion may remain extended into an interior region of the convex regions, thereby resulting in an inter-fiber proximity in the intermediate portion that is less than an inter-fiber proximity in the upper end of the wringer. At least a fraction of the fibers proximate to the an interior side of the convex regions remain in a non-twisted state under application of the first force, thereby permitting the flow of fluids from the upper portion into lower portion of and out drainage exits An increase in twisting forces may result in a second compression force that initiates twisting of the fibers in the intermediate section, thereby resulting in a downward progression of a twisting of the fibers. For example, fibers in the intermediate section will twist around the central axis and away from the convex regions in a downward progression.

Further aspects relate to a cleaning implement comprising an elongate member having a first end and a second end. The cleaning implement may include a wringer configured to be slidably positioned along at least a portion of the elongate member. A connection assembly may be configured to be mounted on the second end of the elongate member and secure a plurality of mop fibers. The connection assembly may include a top portion having a first surface defining a first outer perimeter along a horizontal plane and a downward-extending vertical wall extending parallel with the elongate member, the wall being proximate to the outer perimeter of the first planar surface. The connection assembly may further include a bottom portion. The bottom portion may have a second planar surface defining a second outer perimeter along the horizontal plane that is larger than the second outer perimeter. In certain embodiments, securement of mop fibers between the first and the second planar surfaces, the vertical wall of the top portion is configured to force the plurality of mop fibers to traverse from radiating along the horizontal plane towards a downward vertical direction.

Further aspects relate to connector assemblies for the mop fibers. In an embodiment the connector assembly may be configured to allow for easier assembly of the mop fibers to a mop elongate member.

BRIEF DESCRIPTION OF THE DRAWINGS

A more complete understanding of the present invention and certain advantages thereof may be acquired by referring to the following detailed description in consideration with the accompanying drawings, in which.

DETAILED DESCRIPTION

Figure 1:
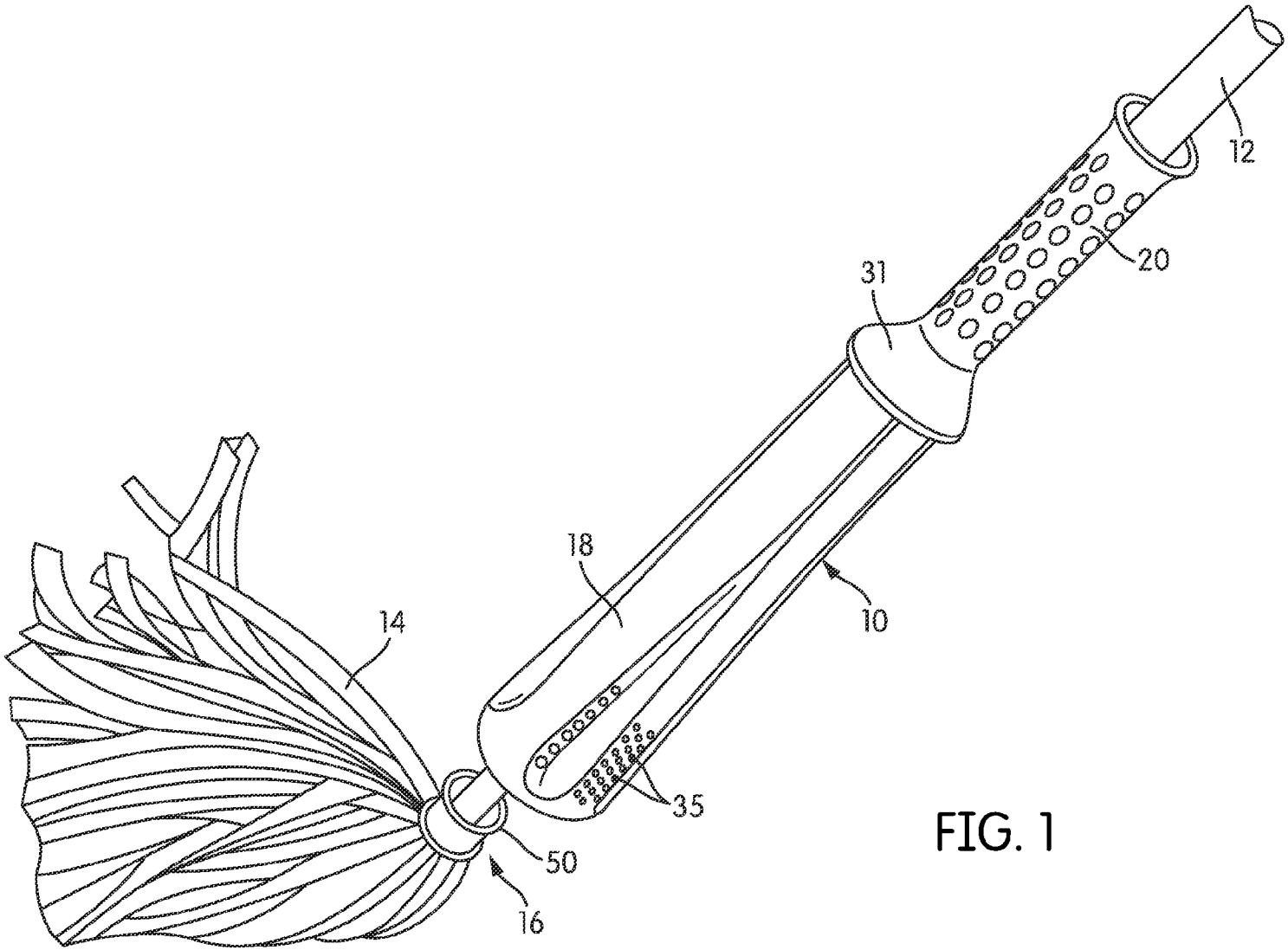
FIG. 1 is a perspective view of a wringer mop in accordance with one embodiment of the invention.

In the following description of various example structures in accordance with the invention, reference is made to the accompanying drawings, which form a part hereof, and in which are shown by way of illustration various example cleaning implements, wringers, and connection assemblies in accordance with the invention. Additionally, it is to be understood that other specific arrangements of parts and structures may be utilized and structural and functional modifications may be made without departing from the scope of the present invention. Also, while the terms "top," "bottom," "front," "back," "rear," "right," "left," and the like may be used in this specification to describe various example features and elements of the invention, these terms are used herein as a matter of convenience, e.g., based on the example orientations shown in the figures and/or the orientations in typical use.

FIGS. 1-4 show one embodiment of an illustrative mop 10 in accordance with one embodiment of this disclosure. The illustrated mop may include an elongate member 12, a set of mop elements 14 on an end 16 of the elongate member 12, and a wringer cup 18. To fasten the mop elements 14 to the end 16 of elongate member 12, a connector assembly 50 is provided.

It is conventionally known that the elongate member for such mops can be a lightweight metal tube, however, any rigid structure, including wood and or plastic may be employed. The illustrated elongate member includes an optional hand grip 20, discussed below.

The mop elements 14 that are illustrated take the form of flat strips. It is conventionally known that such strips can be made from (for example) water-absorbing non-woven fibrous material that is around 18 or 19 inches long and about 0.15 inch thick in its non-compressed state. Other materials could also be used.

Figure 3:
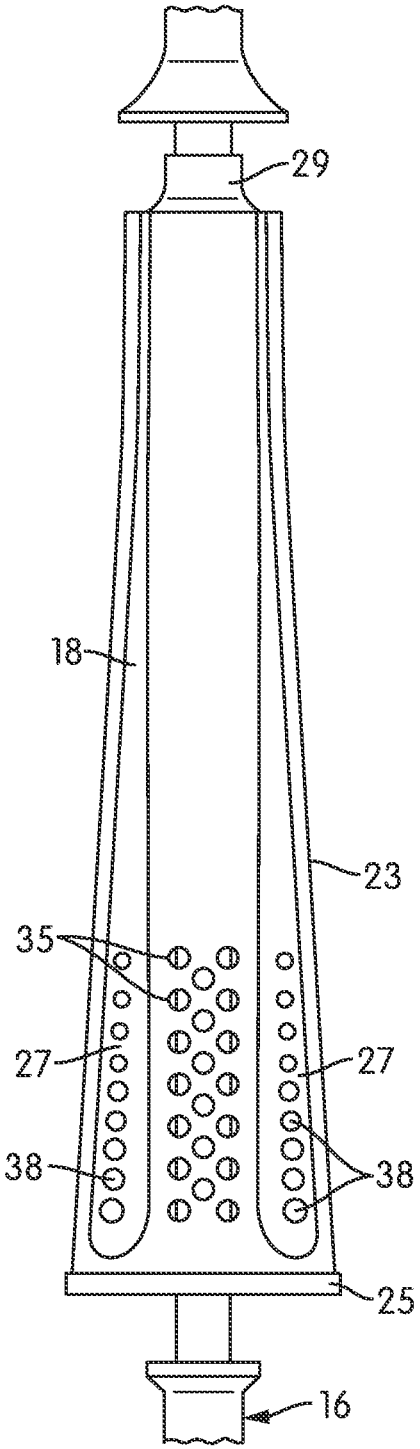
FIG. 3 is an enlarged side elevational view of the wringer cup depicted in FIG. 1.
Figure 4:
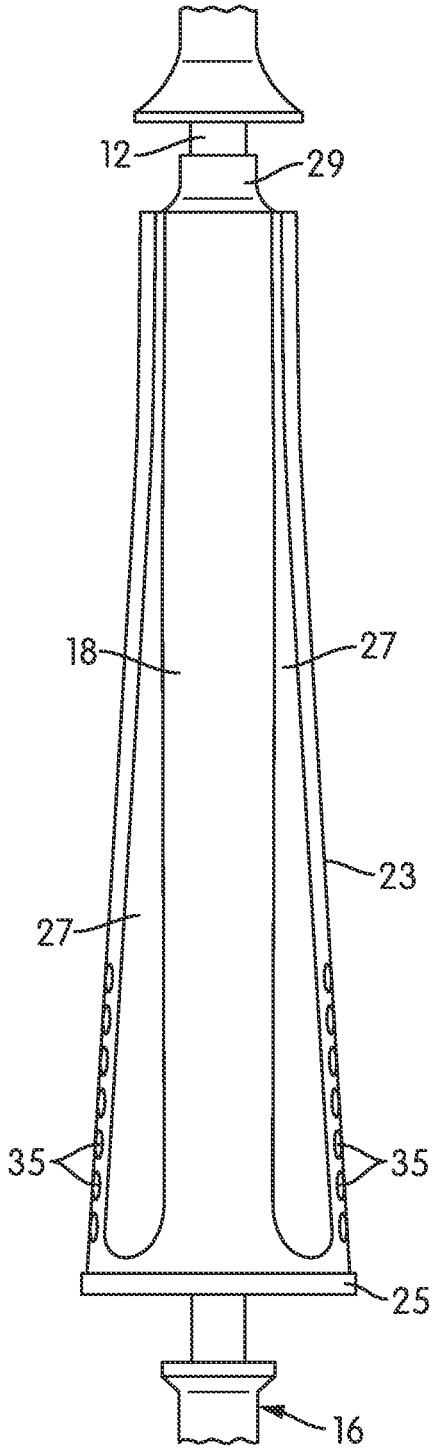
FIG. 4 is a rotated side view of the wringer cup depicted in FIG. 3.

As seen in FIGS. 3 and 4, the illustrated wringer cup 18 may be disposed on the elongate member 12 above the mop elements 14, and has an outer wall 23 that tapers outwardly toward a lower end 25. The precise shape and arrangement of the wringer cup may not be important to various embodiments of the invention, however, is important to other embodiments disclosed herein. It is conventionally known that wringer cups used on such mops are preferably slidably mounted on the elongate member, such as member 12, and may take the form of a tubular shell that can be molded in one piece from a polymeric material such as polypropylene. It is also conventionally known that such wringer cups may include ribs 27 that help to squeeze liquid from the mop fibers during wringing.

Figure 2:
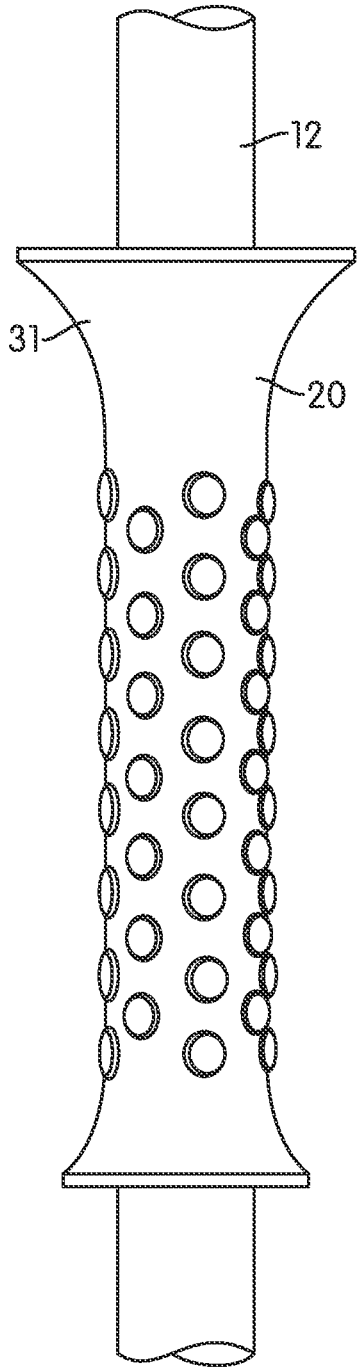
FIG. 2 is an enlarged side elevational view of the handgrip depicted in FIG. 1.

The optional hand grip 20 that has been illustrated in FIG. 2 is mounted on the elongate member 12, above the mop elements 14. The hand grip is arranged to hold the wringer cup 18 above the mop elements fibers when the mop is being used. This position is illustrated in FIG. 1, in which an upper portion 29 of the wringer cup (seen in FIG. 3) fits within a lower part 31 of the handgrip.

The mop elements 14, which may also be referred to collectively as a mop head, tend to be highly absorbent so as to enable the mop 10 to pick up spills. This absorbency means, however, that when removing the water from the mop elements 14 the water in the vicinity of the mop elements 14 tends to be re-absorbed. The perforations 35 in the wringer cup 18 help allow the water being squeezed from the mop elements 14 to be transported away so as to reduce re-absorption. As discussed below, however, various embodiments have different sized perforations 35. Further embodiments are directed towards the location and dimensions of perforations 35 and/or other exits for fluids.

Embodiments of mop 10 may differ from previously known mops with wringer cups in the perforations 35, 38 on the wringer cup 18. As best seen in FIGS. 1, 3, 5 and 13, the illustrated perforations are disposed near the lower end 25 of the wringer cup. As seen in FIGS. 1 and 3, the illustrated perforations preferably have a width that is no more than about one-third the diameter of the elongate member 12, and are less than the width of the flat strips that form the mop elements 14 on the end of the elongate member.

Figure 5:
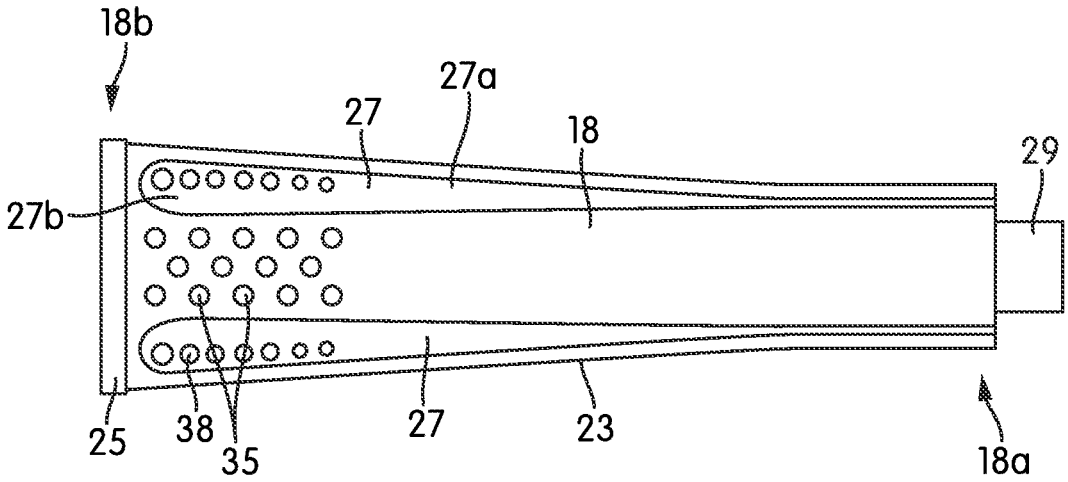
FIG. 5 is an enlarged side elevational view of a second embodiment of the wringer cup.

While the perforations 35 are helpful, additional pathways for removing the water would be useful in certain embodiments. As seen in FIGS. 1, 3 and 5, the ribs 27 may include a plurality of perforations 38, such as arranged in a linear manner. However, the perforations 38 are preferably located to a side 27*a* rather then on a center 27*b* of the ribs 27 so as to not interfere with the compressing of the mop element 14 by the ribs 27 in effecting removal of water. As apparent from FIGS. 3, 5 and 13, the wringer cup 18 includes a first end 18*a* and a second end 18*b*. As can be appreciated, the size of the perforations 35, 38 may be substantially uniform or may be increased from smaller to larger moving towards the second end 18*b* of the wringer cup 18. This is useful for permitting more water to be squeezed out near the second end 18*b* than the first end 18*a* of the wringer cup 18. In other embodiments, different configurations and size patterns, such as alternating smaller and larger, of perforations may be used.

Figure 6:
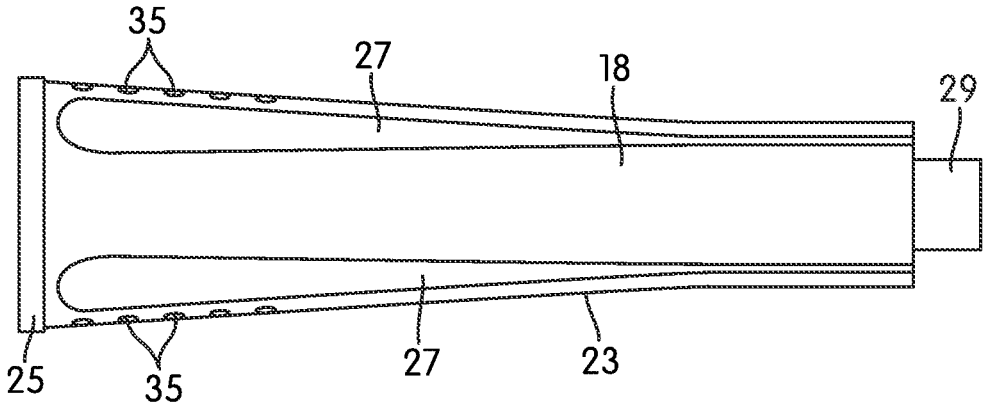
FIG. 6 is a rotated side view of the wringer cup depicted in FIG. 5.
Figure 7:
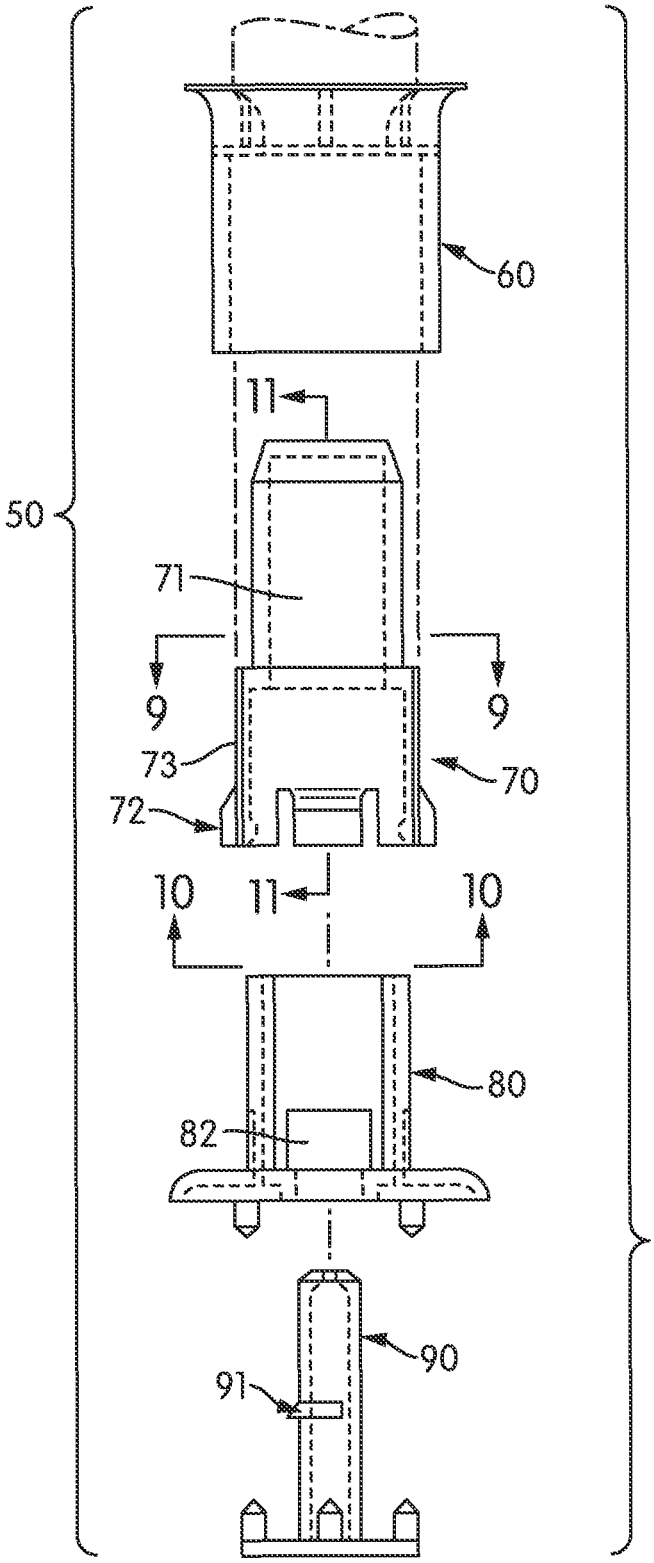
FIG. 7 is an exploded side view of an embodiment of a connector assembly in accordance with one embodiment of the invention.

FIG. 6 illustrates a side view of the wringer cup depicted in FIG. 5. It should be noted that because of the angle, the perforations 38 in the ribs 27 are not visible. In an embodiment, one or two of the ribs 27 may include the perforations 38. In another embodiment all of the ribs include the perforations on one or both of the sides of the ribs 27 and the perforations are aligned between ribs.

Turning to FIGS. 7-12, features of an embodiment of the connector assembly 50 are illustrated. Looking at FIG. 7, the connector assembly 50 includes a collar 60 configured to be installed over an insert 70. The insert 70 includes a tubular end 71 that is positioned within the elongate member 12. The insert 70 further includes a plurality of tabs 72 on the side walls 73 of the insert 70. The insert 70 supports the inner member 80, and the plurality of tabs 72 engage a plurality of depressions 82 on the inner member 80. In turn, the inner member 80 is configured to engage the outer member 90 so as to hold the mop element 14 in place. In an embodiment, the outer member 90 is inserted into the inner member 80 and the catch 91 holds the outer member 90 in place.

Figure 9:
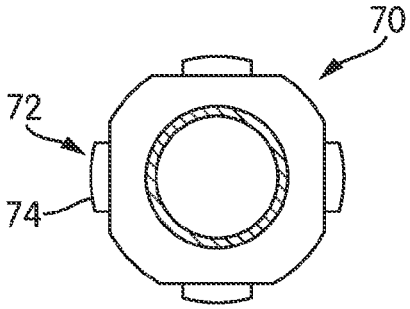
FIG. 9 is a sectional view taken along the line 9-9 in FIG. 7.
Figure 10:
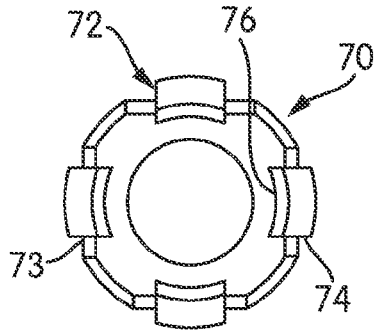
FIG. 10 is a sectional view taken along the line 10-10 in FIG. 7.
Figure 11:
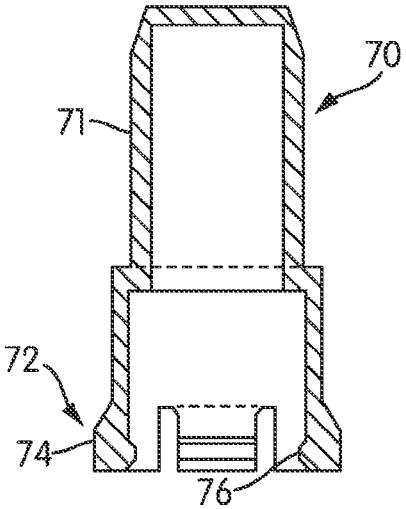
FIG. 11 is a cross-sectional view taken along the line 11-11 in FIG. 7.

FIG. 9-11 illustrate various views of the insert 70. As can be appreciated from these figures, the plurality of tabs 72 include an outer portion 74 and an inner portion 76. The inner portion 76 is configured to engage the depressions 82 on the inner member 80. The outer portions 74 each are of a size and shape suitable to provide a friction point for the collar 60 as the collar 60 is slidably installed over the insert 70 to secure the engagement of the tabs 72 with respect to the inner member 80.

Figure 8:
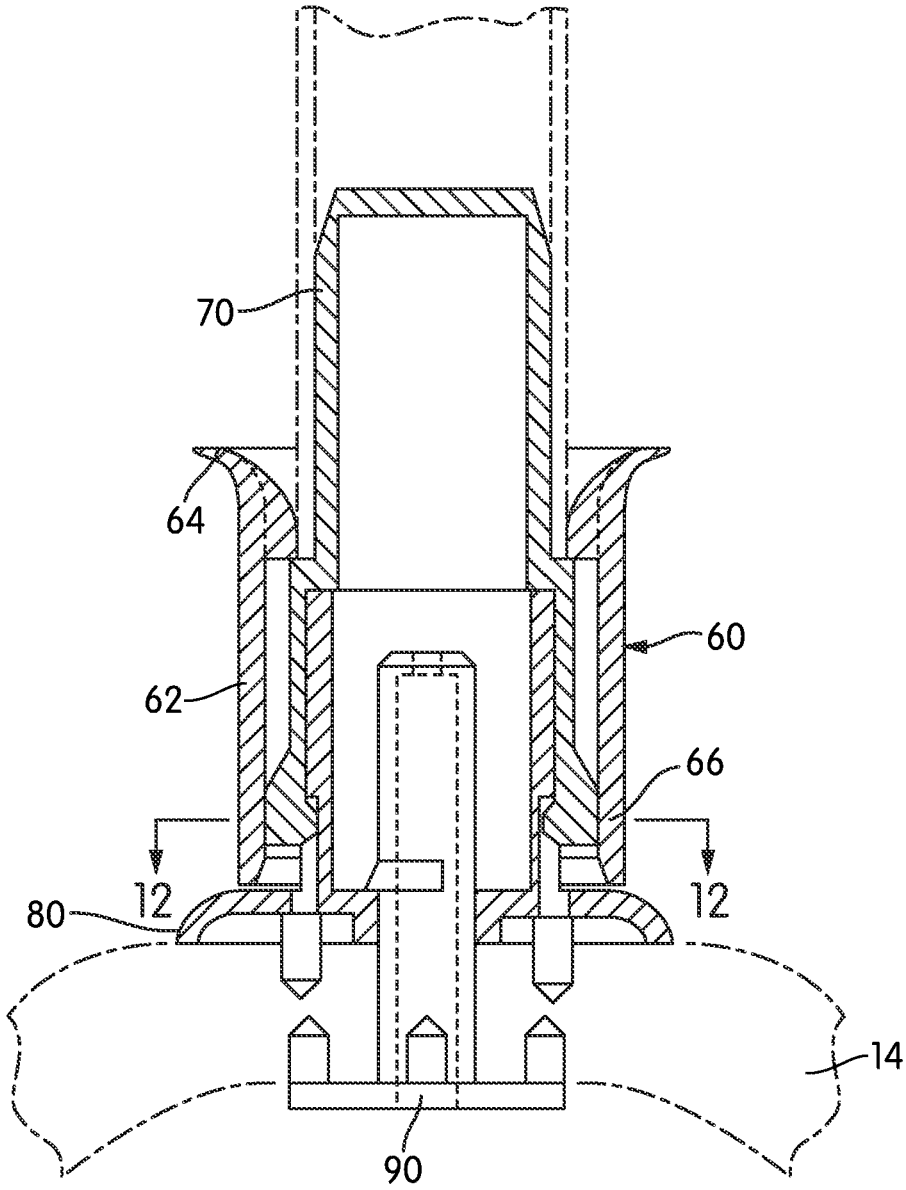
FIG. 8 is an assembled cross-sectional view of the connector assembly depicted in FIG. 7.

FIG. 8 illustrates the components of an embodiment of the connector 50 in the installed position. As depicted, the outer member 90 is inserted into the inner member 80 and together the inner and outer members 80, 90 support the mop element 14. The inner member 80 is held in position by the insert 70 and the collar 60 is positioned around the insert 70. As depicted, the collar 60 includes the chamfer wall 62 that connects the flared edge 64 to the chamfer end 66. The interior surface of the chamfer wall 62 is generally circular in cross-section to allow the collar to be slid over the insert 70 in essentially any rotational orientation. While the chamfer end 66 is not required, it helps the collar be placed in the installed position (as shown) more readily.

When the wringer cup 18 is pulled down over the mop elements 14, some of the water is forced out of the mop elements 14. To squeeze out more water, the wringer cup 18 may be rotated. As can be appreciated, however, rotating the wringer cup 18 is more effective if the mop elements 14 is held in a fixed position relative to the mop elongate member 12. The mop elements 14 are fixed to the elongate member 12 by the insert 70. When the insert 70 is installed, the friction force between the tubular end 71 and the elongate member 12 helps to prevent the insert 70 from moving.

As noted above, the inner and outer members 80, 90 are in turn mounted to the insert 70. Looking at FIG. 12, while the tabs 72 help hold the inner and outer members in place, to resist the twisting force, the inner and outer members 80, 90 are configured in a four sided arrangement that interfaces with the insert 70 so as to prevent rotation.

Figure 12:
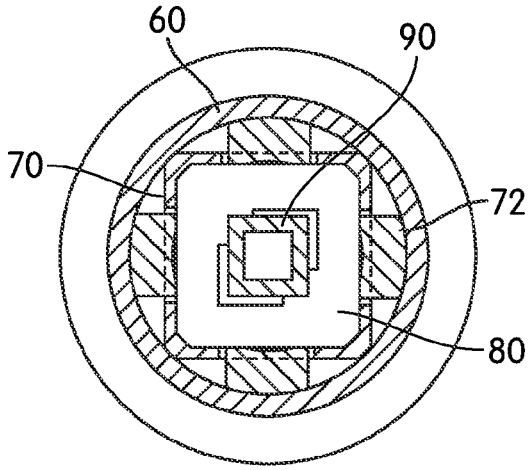
FIG. 12 is a sectional view taken along the line 12-12 in FIG. 8.
Figure 13:
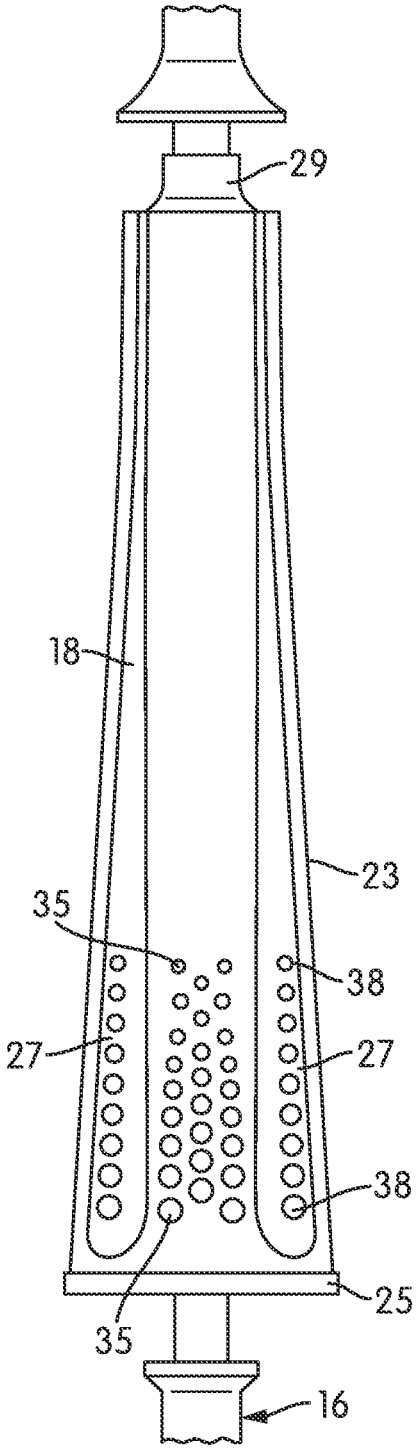
FIG. 13 is an enlarged side elevational view of a third embodiment of the wringer cup.

While the four sided arrangement is useful, configuring the collar 60 in such a corresponding configuration makes the assembly of the connector 50 more complex. Therefore, it is useful to allow the collar 60 to be installed without concern regarding its rotational orientation. To provide this functionality, in an embodiment, the tabs 72 include the outer portion 74 that extend outward. In an embodiment, as depicted in FIG. 12, the outer portion 74 of the four tabs 72 provide a circular like profile that provides a suitable frictional engagement of the collar 60.

Figure 14A:
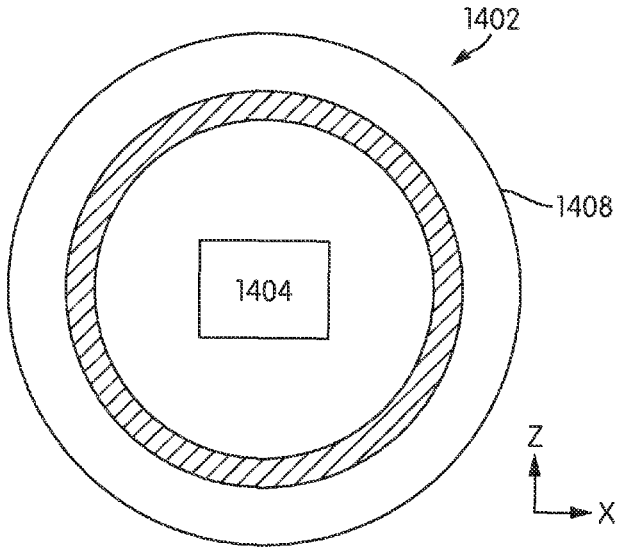
FIG. 14A shows a top view of the exemplary top portion and FIG. 14B shows a cross-sectional perspective view of the illustrative top portion of one possible connection assembly.
Figure 14B:
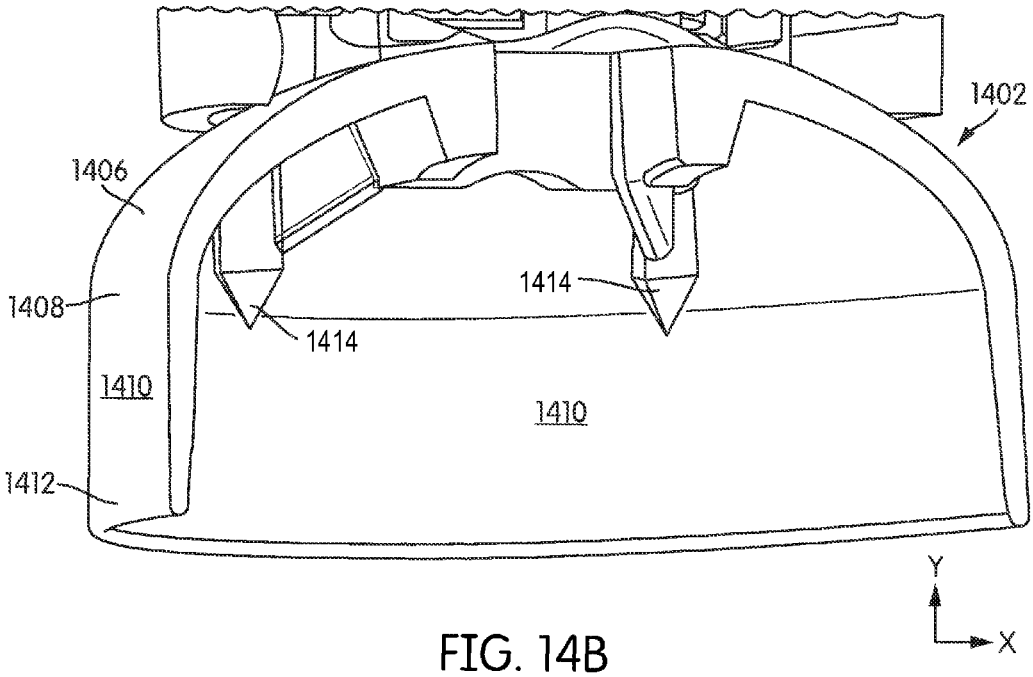

Some of the above examples of a connection assembly show illustrative top portions (for example, inner member 80) and bottom portions (for example, outer member 90) in accordance with various embodiments. As discussed above, the connection assemblies may be configured to retain a plurality of fibers between them. FIG. 14 shows another illustrative example of a top portion (top portion 1402) in accordance with one embodiment of this disclosure. Specifically, FIG. 14A shows a top view of exemplary top portion 1402 and FIG. 14B shows a cross-sectional perspective view of the top portion 1402. Looking first to FIG. 14A, top portion 1402 may comprise one or more structures, such as structure 1404 configured for attachment to an elongate member, such as elongate member 12 shown in FIGS. 1-4. The connection of top portion 1402 to an elongate member 12 may be direct or indirect and/or include one or more structural components positioned between top potion 1402 and elongate member 12.

Top portion 1402 further comprises first surface 1406 that is shown as radiating away from the center. As shown in FIGS. 14A and 14B, first surface 1406 radiates away from a center in a uniform manner to form a circular cross-sectional area. First surface 1406 may further define a first outer perimeter 1408 on a horizontal plane. Because the illustrative outer perimeter 1408 is circular, the diameter of the area within perimeter 1408 may be determined by the diameter of perimeter 1408. In one embodiment, outer perimeter 1408 may have a diameter of about 4 centimeters. Other dimensions, however, are not outside the scope of this disclosure.

Although perimeter 1408 is shown along a horizontal plane, the surface of structure 1406 is not required to be planar with respect to the horizontal plane. For example, as best seen in FIG. 14B, surface 1406 may travel along a vertical direction, such as by curving in a downward manner along the y-axis. As further shown in FIG. 14B, top portion 1402 may include a downward-extending vertical wall, such as wall 1410, proximate to the outer perimeter 1408 of the first surface 1406. In the illustrative embodiment, the vertically downward-extending wall 1410 may be an extension of surface 1406. In certain embodiments, presence of downward curves in structure 1406 in conjunction with wall 1410 may permit a larger quantity of fibers to be secured between the top portion 1402 and a bottom portion (see, e.g., 1502 of FIG. 15) than if wall 1410 was utilized without any curvature in structure 1406.

In certain embodiments, wall 1410 may be a substantially vertical wall, such that it is parallel with a vertical plane and perpendicular to the horizontal plane. Thus, vertical wall may be about 90 degrees from the horizontal axis. In such an embodiment, outer perimeter 1408 may be the outer-most perimeter of top portion 1402. In one embodiment, wall 1410 may be about 2 centimeters in length along the vertical axis. In yet other embodiments, vertical wall 1410 may be about 1 degree to about 10 degrees from the vertical axis. In yet other embodiments, wall 1410 may be less than 45 degrees from the vertical axis and surface 1406 may curve to about 1 degree to about 44 degrees from the horizontal axis.

Although wall 1410 is shown as a solid and uniform structure, those skilled in the art with the benefit of this disclosure will appreciate that there is no requirement that wall 1410 be so. For example, lower edge 1412 of wall 1410 may be jagged, curved, irregular and combinations thereof. In certain embodiments, portions of perimeter 1408 may be devoid of corresponding portions of vertical wall 1410.

Top portion 1402 may further include spikes 1414 or other structures for applying force and/or penetrating a plurality of fibers, such when used in combination with a bottom portion, such as 1502 of FIG. 15, which will be discussed below. For examples, spikes 1414 may be shaped and/or sized to assist securing fibers between top portion 1402 and a bottom portion.

Figure 15:
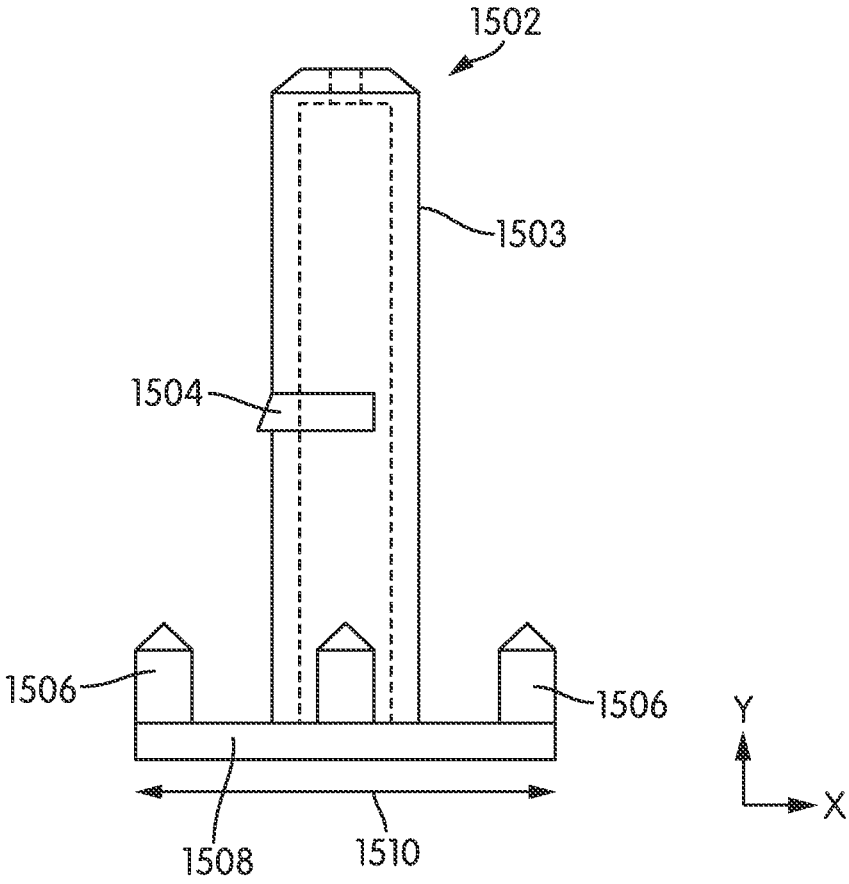
FIG. 15 depicts an exemplary bottom portion of a connection assembly in accordance with one embodiment.

FIG. 15 shows an exemplary bottom portion 1502 that may be used in conjunction with top portion 1402. Bottom portion 1502 may comprise a central upward-extending protrusion 1503 configured to be received by top portion 1402. As shown in FIG. 15, protrusion 1503 may include or more retaining structures, such as retaining structure 1504 for securing bottom portion 1502 to top portion 1402. Bottom portion 1502 may also comprise one or more structures, such as structures 1506 for applying force upon and/or penetrating a plurality of fibers (see, e.g., structures 1506). The portion of mop fibers secured between the top and bottom portions 1402, 1502 may be substantially limited from rotational movement with respect to the horizontal plane.

In one embodiment, bottom portion 1502 may comprise a first surface, such as surface 1508. In one embodiment, surface 1508 is positioned to be substantially planar with the horizontal plane when bottom portion 1502 is secured with top portion 1402. Surface 1508 defines an outer perimeter that is less than the outer-most perimeter of top portion 1402, such as outer perimeter 1408. In certain embodiments, surface 1508 may be substantially circular. In one embodiment, the cross-sectional distance across (i.e. diameter) of surface 1508 may be about 1.5 centimeters (see element 1510). In certain embodiments, the cross-sectional distance (or diameter) of surface 1508 of bottom portion 1502 may be about 30 to about 40 percent of that across perimeter 1408 and/or the outer-most perimeter of the top portion 1402. In one embodiment, the cross-sectional distance (or diameter) of surface 1508 of bottom portion 1502 may be about 37 to about 48 percent of that across perimeter 1408 and/or the outer-most perimeter of the top portion 1402.

In one embodiment, the top and bottom portions 1402, 1502 may be configured such that upon being secured together with mop fibers between them, wall 1410 may be positioned to force mop fibers to be about parallel with the vertical plane (i.e., along with y-axis). In another embodiment, wall 1410 may be positioned to force mop fibers to be at least 45 degrees from the horizontal plane. In another embodiment, wall 1410 may be positioned to force the plurality of mop fibers at least 65 degrees from the horizontal plane. In yet a further embodiment, wall 1410 may be positioned to force mop fibers at least 75 degrees from the horizontal plane.

In certain embodiments, the size and/or proportion of sizes of the top portion 1402 and bottom portion 1502 may provide improved aspects over various previously-known systems and methods. In one embodiment, the size and/or proportion of the top or bottom portion 1402, 1502 may allow for one or more of the following exemplary improvements: better alignment of individual mop fibers in a vertical orientation, reduction of a fiber twisting on itself, increased turning of the fiber in a rotational manner around the axis of the elongate member 12 during usage of the mop, and combinations thereof. Those skilled in the art with the benefit of this disclosure will readily appreciate that these features are merely exemplary and that other improvements over various prior art devices are not excluded.

Figure 16A:
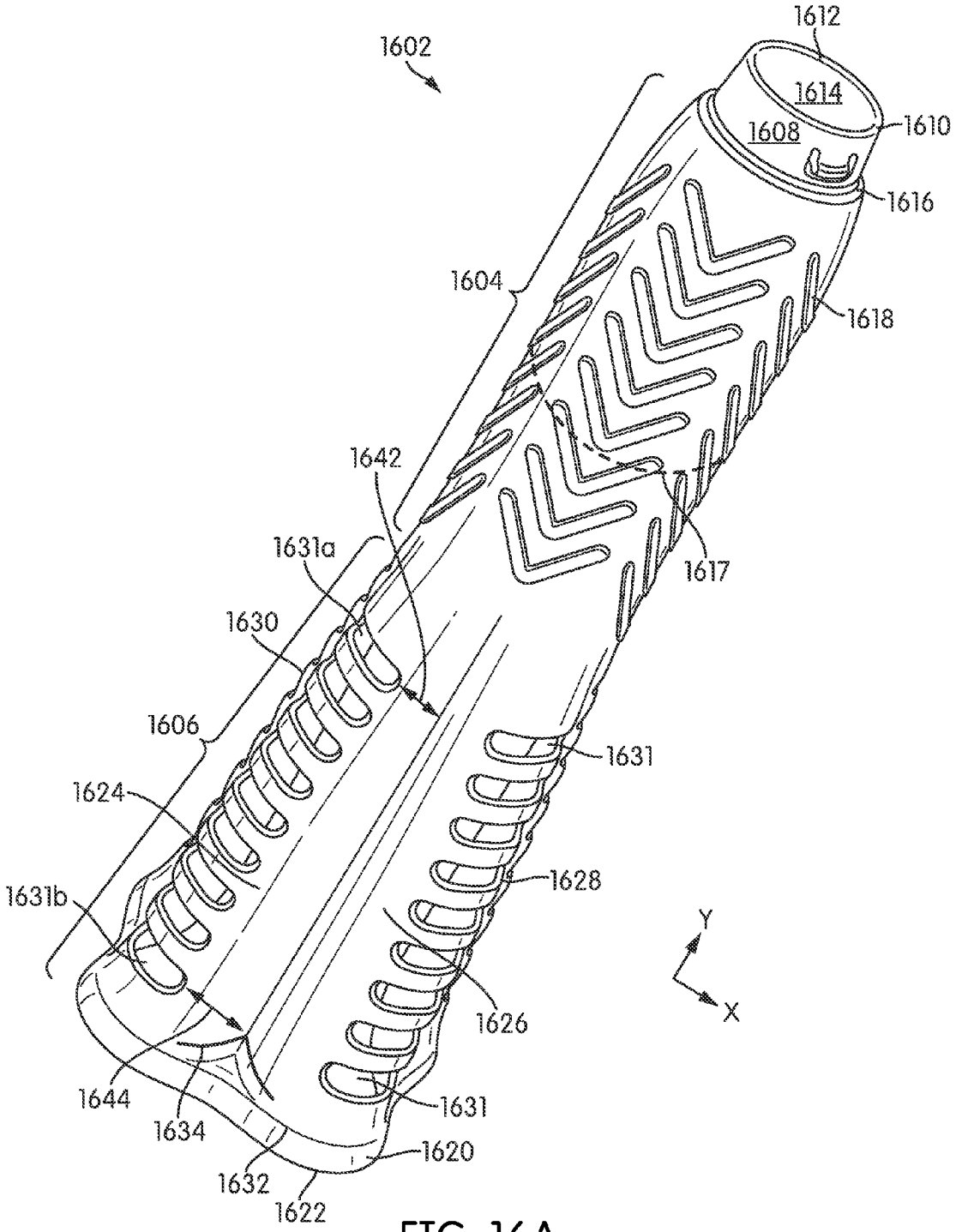
FIG. 16A shows a perspective view.

Further aspects relate to novel wringers as well as wringers having various novel features. FIG. 16A shows a perspective view of exemplary wringer 1602 in accordance with an embodiment of this disclosure. Wringer 1602 may comprise a unitary body having upper end 1604 and a lower end 1606 along a vertical axis (such as the y-axis). In one embodiment, wringer 1602 may be about 25 to about 30 centimeters in length along the y-axis. In yet other embodiments, it may be about 28 to about 29 centimeters. In still yet further embodiments, wringer 1602 may be about 28.5 centimeters in length.

Looking first to the illustrative upper end 1604, it may have a terminus 1608 defining a first outer perimeter (see perimeter 1610). In certain embodiments, outer perimeter 1610 may be substantially circular or oval. Terminus 1608 may further include a first inner perimeter 1612 defining a central bore 1614. Central bore 1614 may be configured to permit passage of the elongate member 12 into the interior of wringer 1602. Therefore, in some embodiments, central bore 1614 may be substantially circular. In other embodiments, however, the size and shape of central bore 1614 may vary.

Figure 16B:
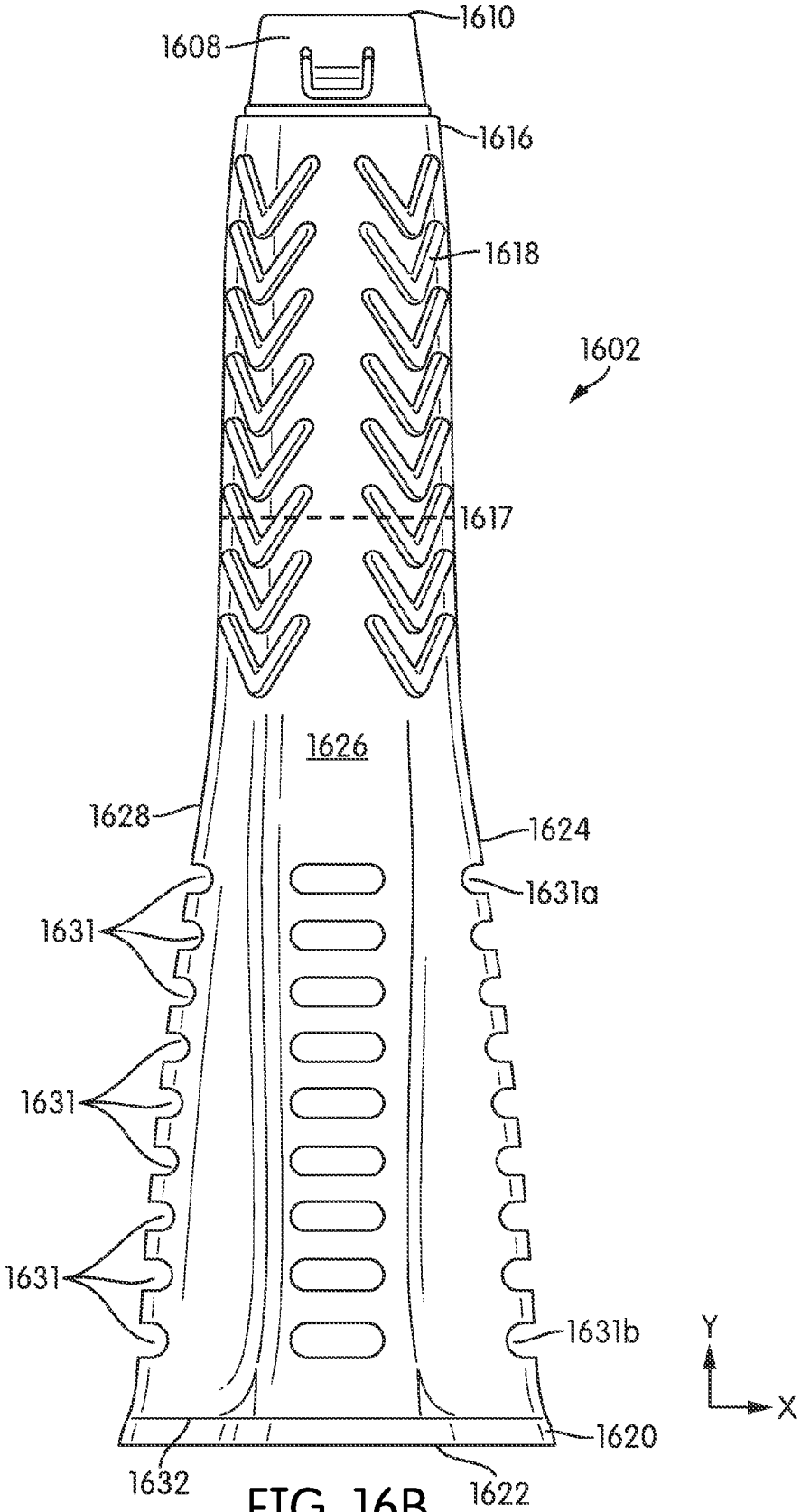
FIG. 16B shows a side view.

Besides terminus 1608, other portions of upper end 1604 may be characterized by a circular or oval perimeter with respect to the horizontal axis. Therefore, in one embodiment, at least a portion of the upper end 1604 may be cylindrical. This is best seen by viewing the side view of wringer 1602 shown in FIG. 16B and the top view shown in FIG. 16C. For example, looking first to FIG. 16B, perimeter 1610 is substantially circular with respect to the horizontal plane of FIG. 16B, therefore is shown as a straight line. In the illustrated embodiment, perimeters 1616 and 1617 are also substantially cylindrical, therefore, the cross-sectional area of wringer 1602 between perimeter 1616 and perimeter 1617 of the illustrated example is substantially cylindrical.

Figure 16C:
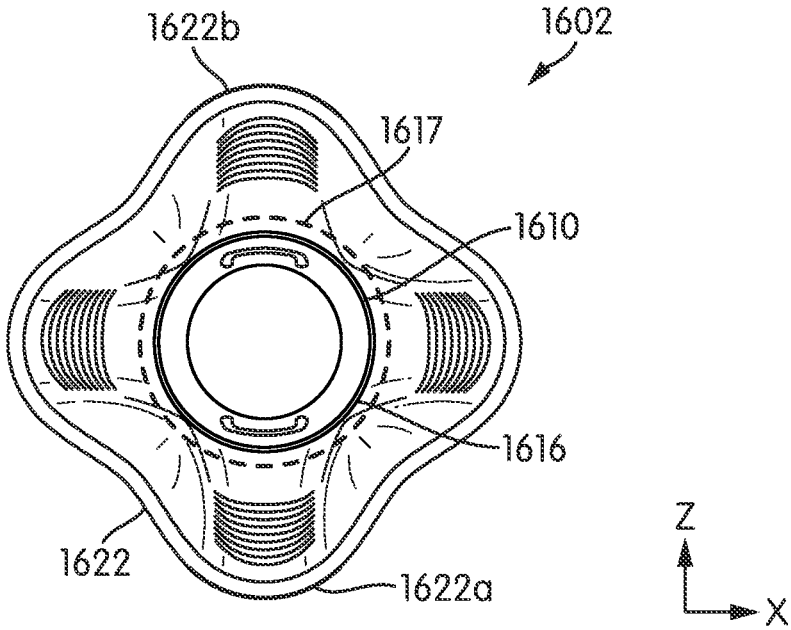
FIG. 16C shows a bottom view and FIG. 16D shows a top view of the illustrated wringer.

Portions of upper end 1604 may be more cylindrical than other portions. For example, terminus 1608 may define a perimeter (i.e., perimeter 1610) that is more cylindrical than a perimeter on a location upper end 1604 that is more proximate to the lower end 1606, such as perimeter 1617. In this regard, the cross-sectional area of upper portion 1604 may become more conical or conic-cylindrical in shape as it approaches the lower end 1606. FIG. 16C shows a bottom view of wringer 1602. As seen in FIG. 16C, perimeters 1610, 1616 and 1617 are each shown as concentric circles in which 1610 is smaller than 1616 which in turn is smaller than 1617. Therefore, in the illustrative embodiment, upper end 1604 of wringer 1602 may form is substantially cylindrical, however, has a slight conical-cylindrical three-dimensional structure. In further embodiments, portions of upper end 1604 may be devoid of a perimeter resembling a cylinder and/or an oval. As will be explained below in relation to a lower end 1606 of wringer

1602, the cross-sectional area or distance of wringer 1602 at various portions of upper end 1604 may be distinctly different from the cross-sectional area or distance of wringer 1602 at various portions of the lower end 1606.

Upper end 1604 may be about 40% to about 60% of the entire length of wringer 1602. In other embodiments, upper end 1604 may be about 45% to about 55% or 47.5% to about 52.5% of the length of wringer 1602. In yet another embodiment, upper portion 1604 is about 50% of the length of wringer 1602. In further embodiments, upper portion 1604 may be about 12 to about 18 centimeters in length. In one embodiment, upper portion 1604 may be about 15 to about 16 centimeters in length. In certain embodiments, upper portion 1604 may be characterized in its absence of voids or protrusions for water removal during operation of the wringer 1602. Upper end 1604 may be defined by the lack of the voids as well as a cylindrical shape that is distinct from the lower portion 1606.

Unlike other prior art systems and methods which teach the benefits of using as many voids on a wringer for the removal of water from mop fibers, embodiments of this disclosure are directed towards an upper portion of a wringer cup, such as upper end 1604 of wringer 1602, that is substantially totally devoid of any voids with the exception of bore 1614. For example, as shown in the illustrative embodiment, upper end 1604 is devoid of any protrusions or voids for the drainage of water. Further discussions relating to various embodiments will be provided below in relation to exits 1631.

Upper end 1604 may include one or more extrusions or elevated portions, such as structures 1618. Structures 1618 may be configured to be graspable by a user, for example, to maneuver the wringer during operation. In certain embodiments, extrusions 1618 may comprise one or more chevron-shaped patterns, such as shown in the figures.

Lower end 1606 of wringer 1602 may include a terminus 1620 having a second outer perimeter (see, e.g., element 1622). In certain embodiments, the second outer-perimeter 1622 may not be circular or oval. This may be true even in embodiments in which upper end 1604 is substantially cylindrical or conical-cylindrical and/or the first outer perimeter 1610 is substantially circular or oval. Despite the second outer perimeter 1622 not being an oval or circular in certain embodiments, it may comprise one or more convex, concave, curvy and/or rounded components. In the illustrative embodiment, the second outer perimeter 1622 encompasses a larger cross-sectional surface area than the first outer perimeter 1610. Further features of perimeter 1622 will be provided in more detail below. Additionally, perimeter 1622 may include one or more features or qualities described in relation to ledge 1632 and vice-versa. It is to be understood, however, that in certain embodiments, ledge 1632 comprises perimeter 1622. Yet in other embodiments, ledge 1632 is absent from the wringer 1602.

In one embodiment, perimeter 1622 and/or ledge 1632 may be about 26.3 centimeters. In one embodiment, perimeter 1622 is about 2 times the length as perimeter(s) 1610, 1616 and/or 1617. In one embodiment, perimeter(s) 1610, 1616 and or 1617 may be about 50-60% of perimeter 1622. In another embodiment, perimeter(s) 1610, 1616 and/or 1617 may be about 55% of perimeter 1622. In one embodiment, the difference in cross-sectional area between perimeter(s) 1610, 1616 and/or 1617 in the upper end 1604 and perimeter 1622 in the lower end 1606 may be due to the presence of one or more convex or concave regions of the lower end 1606, such as those disclosed below.

Lower end 1606 of wringer 1602 may include one or more convex regions 1624-1630. In the illustrated embodiment, convex regions 1624-1630 may comprise columns. Therefore, regions 1624-1630 may be referred to as "columns" throughout this disclosure in reference to the embodiment shown in FIG. 16 but the reader is advised that the disclosure is not so limited. Convex regions/columns 1624-1630 may be substantially vertical. For example, in the illustrative embodiment, columns 1624-1630 are implemented such that the length is substantially straight, non-curvy (i.e., there is no bending along the horizontal axis)

As seen throughout FIGS. 16A-16D, columns 1624-1630 may be implemented as rounded components that may widen along the horizontal plane (see x-axis) as the distance from the upper end 1604 increases and the distance towards the lower second outer perimeter 1622 decreases. As shown best in FIG. 16D, columns 1624-1630 may terminate at ledge 1632. In this regard, columns 1624-1630 may terminate proximate to the second outer perimeter 1622 at ledge portions 1632*a*-1632*d*, which may be oval and/or circular. In certain embodiments, ledge portions 1632*a*-1632*d* are circular convex for at least 90 degrees. In yet further embodiments, ledge portions 1632*a*-1632*d* may be circular convex for at least 135 degrees, yet in other embodiments they may form half-circles and thus be about 180 degrees. In this regard, certain embodiments of convex regions 1624-1630 may be implemented as cross-sectional splices of conical or conical-cylindrical structures. For example, as best seen in FIG. 16C, perimeter 1622 may comprise rounded component 1622*a*.

In certain embodiments, a pair of rounded components (see components 1622*a* and 1622*b*) may be positioned in an opposing manner, such as shown in FIG. 16C. Those skilled in the art with the benefit of this disclosure will appreciate that any range of circular shapes is within the scope of this disclosure. Outer perimeter 1622 may be substantially identical to ledge 1632, such that corresponding portions of perimeter 1622 have substantially the same shape as ledge 1632 or those described in relation to 1632.

Convex regions/columns 1624-1630 may be positioned in an opposing manner, such as shown in FIG. 16C. In the illustrative embodiments, two pairs of rounded components are shown, each being about 90 degrees from each other with regard to the horizontal plane. In one embodiment, the positioning of the four convex regions 1624-1630 may be such that a generally square shape is formed (See FIG. 16D). In one such embodiment, a lower portion of the convex regions is more square shaped than the upper portion of the convex regions. In this regard, ledge 1632 may be generally square-shaped. Those skilled in the art will appreciate that other shapes are within the scope of this disclosure.

Specific embodiments are directed towards the implementation of convex regions that provide a wringer 1602 with a non-circular cross-sectional across a horizontal plane. Further implementations may utilize convex regions, including regions 1624-1630, such that the lower end 1606 of the wringer 1602 has an increased cross-sectional area when compared to the upper portion 1604. In certain embodiments, this may result in less pressure against the corresponding mop fibers. In further embodiments, mop fibers having less pressure against the wringer 1602 may permit the expansion of mop fibers when compared to inter-fiber proximity in the upper end 1604 of the wringer 1602. In certain embodiments, decreased inter-fiber proximity may results in the improved water drainage over prior art systems and methods. For example, perimeter 1622 may be substantially square shaped. Examples of improved drainage are also discussed in more detail in relation to FIG. 17.

Figure 16D:
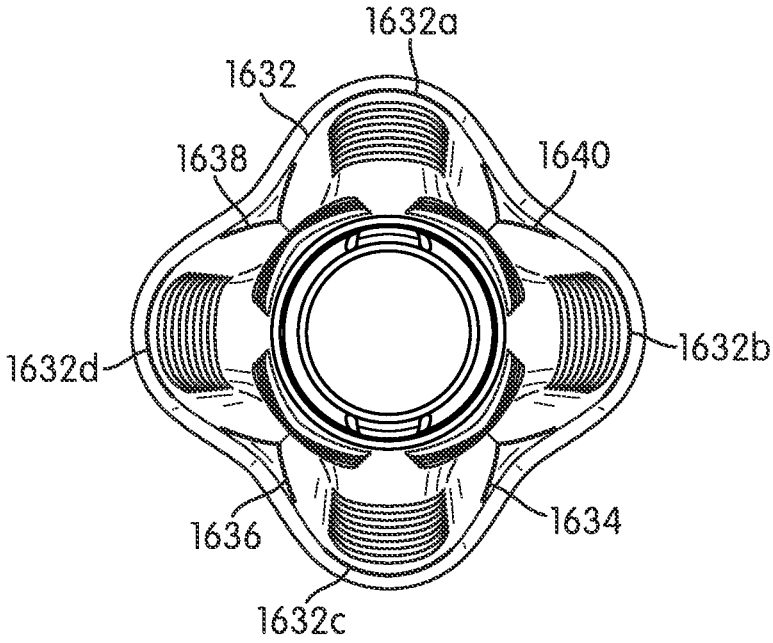

Aspects of the invention should not be limited to outer perimeter 1622 consisting of opposing rounded surfaces or pairs of the same. Other shapes and configurations are within the scope of this disclosure. Further, certain embodiments are directed towards component being concave such as concave regions 1634-1640. (FIG. 16D shows the general shape of illustrative regions 1634-1640 as an imaginary line located proximate to ledge 1632 and/or perimeter 1622 and FIG. 16A shows a possible shape of a portion of concave region 1634). Looking to FIG. 16A, concave region 1634 may be formed by the presence of adjacent convex regions, such as regions 1624 and 1626. In certain embodiments, each of the concave regions 1634-1640 may be formed by the presence of adjacent convex regions, such as regions 1624-1630. For example, the joining of convex regions 1624 and 1626 forms concave region 1634. Therefore, various locations on the surface may be part of a concave and a convex region. One or more concave regions may be substantially inverse to a convex region, such as 1624-1630.

Concave regions 1634-1640 may be described in some embodiments as a plurality of inward extending ribs. As seen in FIGS. 16A-16D, each rib comprising a first side and a second side that converge to form a rib bottom. The bottom may be the most-inner curvature of the concave regions 1634-1640. As explained in more detail below, concave regions 1634-1640 may be devoid of any drainage exits, therefore, in certain embodiments, the rib bottom and the rib sides may be substantially devoid of any perforations.

Similarly, convex regions 1624-1630 may be described in some embodiments as a plurality of outward extending ribs. As seen in FIGS. 16A-16D, each outward rib comprising a first side and a second side that converge to form a rib top. The top may be the outer-most curvature of the convex regions 1624-1630. As explained in more detail below, convex regions 1624-1630 may comprise drainage exits, therefore, in certain embodiments, the rib top and the rib sides may comprise perforations. In certain embodiments, only the outer-most curvature of the convex regions 1624-1630 comprises perforations.

Adjacent convex regions 1624-1630 and concave regions 1634-1640 may share a common side. For example, a first side of a rib of a concave region may be a first or second side of a rib for a convex region. In certain embodiments, the concavity of a concave region may be equal to the convexity of an opposing and/or adjacent convex region 1624-1630. In yet other embodiments, one or more concave regions 1634-1640 may be unrelated to the shape and/or curvature of one or more convex regions 1624-1630. Concave regions 1634-1640 may widen along the horizontal plane (see x-axis) as the distance from the upper end 1604 increases and the distance towards the lower second outer perimeter 1622 decreases. As shown best in FIG. 16D, columns 1634-1640 may terminate at ledge 1632.

The combination of convex regions 1624-1630 and concave regions 1634-1640 may provide improved drainage characteristics of over prior designs. In one embodiment, the cross sectional area across the horizontal plane (along the x-axis) in lower end 1606 of wringer 1602 may resemble an "X". The cross-sectional diameter of the lower end 1606 proximate to perimeter may be at least twice that of the corresponding cross-sectional diameter of the lower end 1606 proximate to the upper end 1604 of the wringer 1602. In one embodiment, cross-sectional diameter of the lower end 1606 proximate to perimeter may about 200% of the corresponding cross-sectional diameter of the lower end 1606 proximate to the upper end 1604 of the wringer 1602. In one embodiment, the wringer's 1602 circumference at a location of lower end 1606 that is immediately adjacent to the upper end 1604 may be substantially circular or oval and have a perimeter about 14 to about 15 centimeters and the location of the lower end 1606 immediately adjacent to perimeter 1622 may be non-circular or oval and have a perimeter of about 26 to about 27 centimeters.

The presence of concave regions 1634-1640 as disclosed may result in an application of pressure against at least an outer portion of mop fibers during use of the wringer 1602. As shown in the illustrated embodiment, each of the concave regions 1634-1640 are substantially devoid of any drainage exits or ports, such as exits 1631. One or more convex regions 1624-1630 may comprise drainage exits, such as plurality of exits 1631. In certain embodiments, drainage exits 1631 may be positioned substantially along the length of convex regions 1624-1630. (For simplicity, exits 1631 are not each individually labeled, however, it is apparent from the FIGS. that the unmarked exits may form part of exits 1631).

As shown in the FIGS. each of the regions 1624-1630 may comprise one or more exits, such as exits 1631. In one embodiment, plurality of exits 1631 may be positioned along at least 75% of the vertical length (parallel to the elongate member 12 of FIGS. 1-4 of the convex region(s) 1624-1630. Yet in other embodiments, plurality of exits may be at least along 80%, 85%, 90% or 95% of the vertical length of the convex region 1624-1630. In one embodiment, there may be 8 to 10 vertically arranged exits 1631 positioned along the length of each region 1624-1630. In one embodiment, there are 9 exits 1631 per region 1624-1630.

Positioning and/or placement of drainage exits 1631 may be configured to provide improved drainage over existing designs. For example, as an outer portion of mop fibers contact the inner perimeter of convex regions 1624-1630 of the lower end 1606, exits 1631 may permit improved drainage capabilities. In this regard, draining exits 1631 may only be provided on an outer most surface of the convex regions 1624-1630. In one embodiment, only one exit is provided on any given horizontal plane for each column or convex region 1624-1630. For example, looking to FIGS. 16A-16D, exits 1631 are provided as lateral slits having a horizontal lengths that are greater than their vertical height.

Upper most exit 1631*a* of region 1624 (or any other exit) may be about 0.5 centimeters in height and about 2 centimeters in length. In another embodiment, exit 1631*a* may be about 0.5 to about 0.7 centimeters in height and about 2.0 to about 2.2 centimeters in length. Having exits with a length greater than the height may be advantageous, either alone or in combination with other elements of this disclosure. In one embodiment, exit 1631*a* and/or any of plurality of exits 1631 may have a height that is about 25-30% of its length. In yet other embodiments, exit 1631*a* and/or any of plurality of exits 1631 may have a height that is about 28.5% of its length. Exit 1631*a* may be at least about 1 centimeter away from the interior-most location of adjacent concave regions, such as region 1634. This parameter is shown in FIG. 16A as 1642.

In certain embodiments, plurality of exits 1631 may each have the same general shape, such as shown in the FIGS. This, however, is not a requirement. Further, different exits with the plurality of exits 1631 may have different dimensions relative to the dimensions of the convex regions 1624-1630. In one embodiment, as convex regions 1624-1630 expand away from the center of the wringer 1602 dimensions of the corresponding exits may also change at a predictable rate. For example, exit 1631*b* may be about 0.7 to about 0.9 centimeters in height and about 2.0 to about 2.2 centimeters in length. In one embodiment, exit 1631*b* may be about 0.8 centimeters in height and about 2.1 centimeters in length. In certain embodiments, exit 1631*b* and/or any of plurality of exits 1631 may have a height that is about 35-40% of its length. In other embodiments, exit 1631*b* and/or any other plurality of exits 1631 may have a height that is about 38% of its length. Exit 1631*b* may be at least about 2 centimeters away from the interior-most location of adjacent concave regions, such as region 1634. This parameter is shown in FIG. 16A as 1644.

Figure 17:
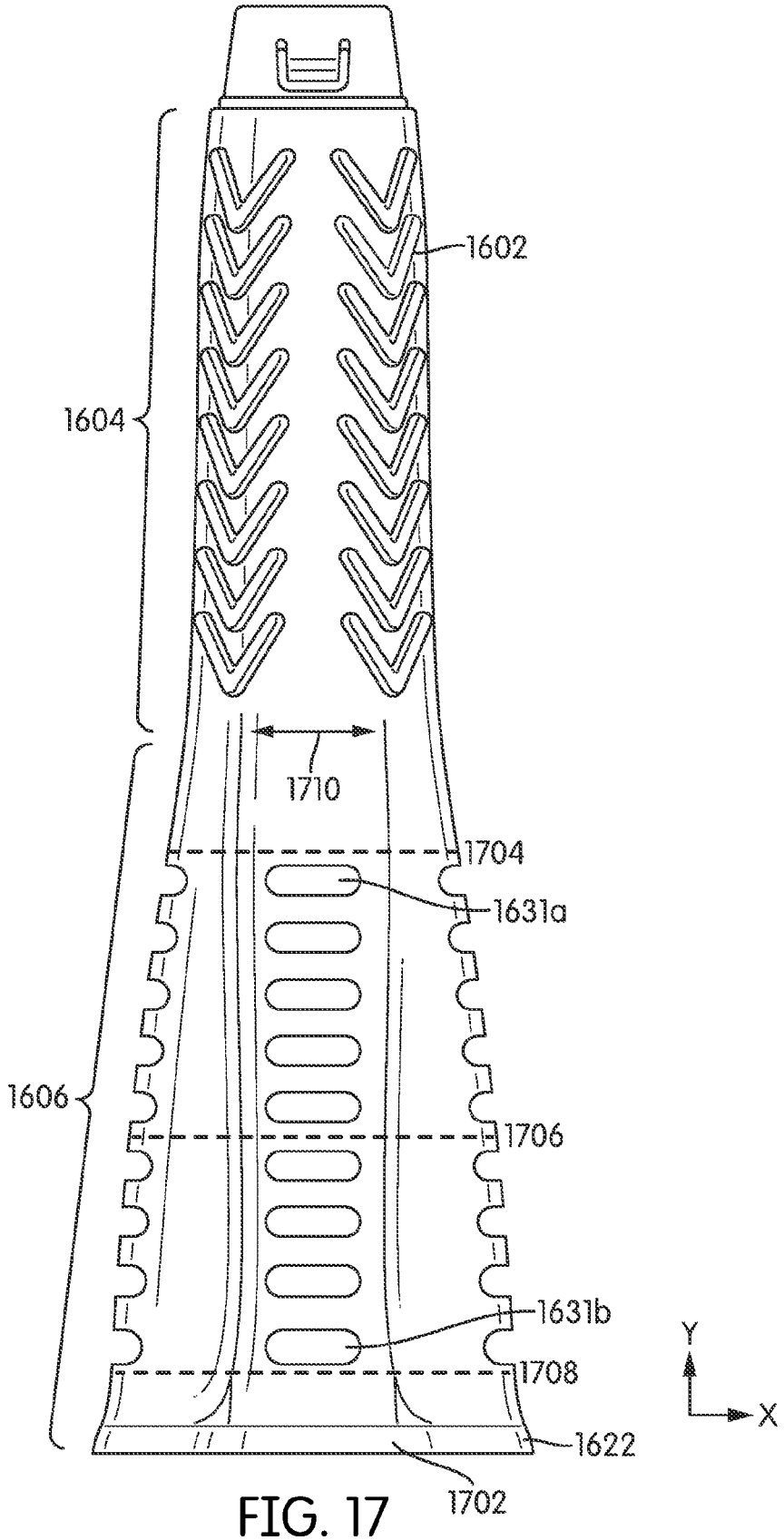
FIG. 17 shows a side view of an illustrative wringer in accordance with one embodiment.

As shown in FIG. 17, aspects of the invention relate to a cleaning implement that permits a plurality of mop fibers to be retracted up through the bottom, such as by perimeter 1622, and in a vertical direction towards the upper end 1604 of wringer 1602. For example, mop fibers, which may be connected to a connection assembly similar or identical to the connection assembly of FIG. 14 may be retracted along direction 1702 up into an interior of wringer 1602. In one embodiment, the fibers may be water-absorbing non-woven fibrous material. The fibers may be strips that are around 18 or 19 inches long and about 0.15 inch thick in its non-compressed state. Other materials and dimensions may also be used.

The plurality of fibers may be retracted in a vertical manner such that individual fibers will have an upper portion located at least above the upper most exit, such as 1631*a*. For example, at least a portion of the mop fibers may be above imaginary line 1704 when fully retracted in wringer 1602. A vertical wall, such as wall 1410 may be utilized, either alone or in conjunction with the upper end 1604 of wringer to position at least an outer portion of fibers located above imaginary line 1704 to be in a substantially vertical orientation. In one embodiment, an outer portion of mop fibers located in the upper end 1604 of wringer are configured to be in a substantially vertical orientation when the fibers are fully retracted into the wringer 1602.

The upper portion of fibers will travel in a downward vertical manner towards an intermediate portion, which may be located below the upper most exit, such as exit 1631*a* but above the lower most exit, such as exit 1631*b*. In one embodiment, intermediate portions of the mop fibers will be proximate to imaginary line 1706. A lower portion of the same fibers may be proximate but vertically lower than the intermediate portion. For example, the lower portions of the fibers may be proximate to or below the lowest-most exit, such as exit 1631*b*. In one embodiment, lower portions of the fibers may be proximate, but vertically lower than, imaginary line 1708.

Upon the mop fibers being retracted into wringer 1602, wringer may be configured to rotate about a central axis, such as an elongate member, such as elongate member 12 of FIGS. 1-4 provided through bore 1614 (shown in FIG. 16A) located on the upper end 1604 of wringer 1602. For example, arrows 1710 show that wringer 1602 may be rotated in either horizontal direction along the vertical axis. The vertical positioning of the mop fibers, either as a result of the connection assembly and/or the shape or size of the wringer 1602 may result in improved drainage. In one embodiment, rotating the mop along one of directions 1710 may result in only a portion of the mop fibers to be "wrung." For example, in one embodiment, the upper portion of mop fibers (which may be located proximate to location 1704 or above exit 1631*a*) will begin to twist before the intermediate portion of mop fibers (which may be located proximate to location 1706). In further embodiments, intermediate portion of mop fibers (which may be located proximate to location 1706) may begin to twist before the lower portion of mop fibers (which may be located proximate to location 1708 or exit 1631*b*).

In certain embodiments, as the upper portion of mop fibers (which may be located proximate or above location 1704 may be twisted to remove fluids within fibers. At the same time, intermediate and/or lower portions of the fibers may be located against an interior side of the convex regions 1624-1630. Thus, certain embodiments permit the flow of fluids from the upper portion of mop fibers down into the intermediate and/or lower portion of the fibers and out exits 1631. Fluids may also exit through the opening created by perimeter 1622. As the fibers are wrung, the twisting force upon the upper portion mop fibers will increase and may result in twisting of the intermediate portion of the fibers. In certain embodiments, the intermediate fibers are also twisted along direction 1710 may result in removal of fluids from the twisted intermediate portions of the fibers, which may travel down to lower fibers in the intermediate portion and/or to the lower portion of mop fibers.

Positioning of the concave regions 1634-1640 may provide a rigid surface resulting in compression forces upon the fibers as they are twisted. Fluid may continue to be removed through lower-positioned exits, such as exit 1631*b* and/or the bottom. As mop fibers are twisted, the shape and/or size of the wringer 1602, alone or in combination, with the vertical alignment of the fibers resulting from a vertical wall on a connection assembly, may result in the fibers twisting around the vertical axis and away from the convex regions 1624-1630.

The cleaning implement may further be configured such that application of further twisting forces are transferred downward resulting in twisting of a lower intermediate portion of the fibers. For example, further compression forces may result in a second compression force upon the fibers. In one embodiment, the upper portion of fibers must be twisted at least 25% of a full revolution before the twisting of the intermediate fibers. In another embodiment, the upper portion of fibers must rotate at least 50% of a full revolution before twisting of the intermediate fibers will rotate more than 10% of the revolution. In one embodiment, the upper portion of fibers must rotate at least 50% of a full revolution before twisting of the intermediate fibers will rotate more than 20% of the revolution. In certain embodiments, the lower portion fibers are also twisted along direction 1710, resulting in the removal of fluids from the twisted lower portions of the fibers. This fluid may travel down to lower fibers in the lower portion and/or out the bottom of the wringer 1602. Fluid may continue to be removed through lower-positioned exits, such as exit 1631*b* and/or the bottom.

In certain embodiments, the wringer is configured such that convex regions, such as regions 1624-1630 expand outward away from the vertical axis at a larger rate than concave regions, such as regions 1634-1640. This may be useful for example, when the upper portion of fibers are being twisted prior to the lower portion of mop fibers. For example, because the concave regions 1634-1640 have more cross-sectional area closer to the bottom (i.e., proximate to perimeter 1622), the lower fibers are less compressed than the upper portion of fibers. This may result in an increased water holding capacity of the lower portion of fibers. Therefore, in addition to fluids draining out exits 1631, fluids may also be transferred to lower positioned portions of the fibers as the top portion is twisted. Unlike some prior art methods, these lower positioned fibers are not yet twisted (or at least at the same rate), therefore, increased fluid drainage from the upper portion may be realized. The fibers that are positioned within the cross-sectional area of the concave portions 1634-1640, however, may then be later wrung as the downward-spiraling twisting forces pull them towards the center of the interior.

In one embodiment, the upper portion of fibers must be twisted at least 25% of a full revolution before the twisting of the lower portion of fibers. In another embodiment, the upper portion of fibers must rotate at least 50% of a full revolution before twisting of the lower fibers will rotate more than 10% of the revolution. In one embodiment, the upper portion of fibers must rotate at least 50% of a full revolution before twisting of the lower fibers will rotate more than 20% of the revolution.

Although reference to upper, intermediate, and lower portions was provided in reference to the mop fibers, those skilled in the art will readily appreciate that such references may be analogous to the corresponding sections of the wringer 1602. For example, mop fibers located in an upper section of wringer 1602 may twist under a first compression force before the corresponding portion of those same fibers located in a lower intermediate section and/or a lower section of the wringer 1602.

This detailed description has been given for clearness of understanding only. Modifications may be obvious to those skilled in the art. The intended scope of the invention is set forth in the following claims.

We claim:

1. A cleaning implement comprising:

an elongate member having a first end and a second end along a vertical axis;

a wringer configured to be slidably positioned along at least a portion of the elongate member;

a connection assembly configured to be mounted on the second end of the elongate member and secure a plurality of mop fibers to the elongate member, the connection assembly comprising:

a top portion comprising:

an insert configured to be mounted on the second end of the elongate member and including one or more tabs with an outer portion that extends in a direction away from and transverse to the elongate member when mounted on the elongate member, and an inner portion that extends in a direction towards and transverse to the elongate member when mounted on the elongate member;

a collar configured to be slidably installed over the insert to frictionally engage the outer portion of the one or more tabs, wherein the collar is configured to be frictionally engaged with the one or more tabs regardless of its rotational orientation when installed over the insert; and an inner member comprising one or more depressions configured to be engaged by the inner portion of the one or more tabs when the collar is frictionally engaged with the outer portion of the one or more tabs, the inner member also comprising a first surface defining a first outer perimeter along a horizontal plane and a downward-extending vertical wall extending parallel with the elongate member and perpendicular to the horizontal plane, the wall being proximate to the first outer perimeter of the first surface;

a bottom portion configured to engage with the top portion to secure the plurality of mop fibers, the bottom portion comprising:

a second surface defining a second outer perimeter along the horizontal plane, wherein first outer perimeter is larger than the second outer perimeter; and wherein upon securement of mop fibers between the first and the second surfaces, the vertical wall of the top portion is configured to force the plurality of mop fibers to traverse from radiating along the horizontal plane to a downward vertical direction to provide increased turning of the fiber in a rotational manner around the vertical axis and reduce twisting of the mop fibers upon themselves when using the wringer.

2. The cleaning implement of claim 1, wherein the insert further comprises one or more side walls, where the one or more side walls and the one or more tabs combine to provide a profile having a shape configured for suitable frictional engagement of the collar;

wherein the inner member further comprises one or more side walls in a number corresponding to the number of side walls of the insert, the one or more side walls having the one or more depressions configured to engage with the one or more tabs; and wherein the collar is configured to frictionally engage with the one or more sidewalls of the insert as well as the one or more tabs.

3. The cleaning implement of claim 2, wherein the wringer comprises a unitary body having an upper end and a lower end, the upper end comprising:

a top having a first outer perimeter that is substantially circular and a first inner perimeter defining a central bore configured to permit passage of the elongate member into an inner portion of the unitary body;

the lower end comprising:

a plurality of outward-extending ribs that define a first outer perimeter of the lower end enclosing an X-shaped cross sectional area across a horizontal plane that is perpendicular to the vertical axis; and a terminus defining a second outer perimeter defining a square-like second outer perimeter along the horizontal plane parallel with the first outer perimeter of the lower end of the wringer; and wherein the second outer perimeter that is larger than the first outer perimeter of the upper end and comprises concave and convex regions.

4. The wringer of claim 3, the lower end further comprising:

a plurality of inward extending ribs, each rib comprising a first side and a second side that converge to form a rib bottom, wherein the rib bottom and the rib sides of the inward extending ribs are devoid of any perforations;

wherein the each of the plurality of outward extending ribs comprises a first side and a second side that converge to form a rib top, wherein the rib sides of the outward extending ribs are devoid of perforations and the rib tops each comprise a plurality of perforations; and wherein at least one inward extending rib shares a common side with an outward rib.

5. The cleaning implement of claim 4, wherein the central bore of the wringer is configured to permit the elongate member extend through the inner portion of the wringer; and wherein upon attachment of the second end of the elongate member to a plurality of fibers, the winger is configured such that when the plurality of fibers are retracted through a bottom vertically opposite the central bore, an upper portion of the fibers will be located at least above an upper most perforation of the outward extending ribs and aligned in a vertical manner parallel to a vertical axis between the central bore and a center of the perimeter of the bottom of the wringer and under a first compression force against the wringer.

6. The cleaning implement of claim 5, wherein the wringer is configured such that upon retracting the elongate member fully into the inner portion of the wringer and upon rotation of the wringer around the central axis results in a first compression force causing an initial twisting of the mop fibers located proximate to the elongate member before twisting of corresponding sections of the same fibers located at an intermediate section of the wringer and before twisting of corresponding sections located at a lower section of the wringer proximate to the lower-most perforation;

wherein fibers in the intermediate portion extend into an interior region of the convex regions formed in the wringer, resulting in an inter-fiber proximity in the intermediate portion that is less than an inter-fiber proximity in the upper end of the wringer; and wherein at least a fraction of the fibers proximate to an interior side of the convex regions remain in a non-twisted state under application of the first compression force, permitting the flow of fluids from the upper portion into lower portion of and out perforations.

7. The cleaning implement of claim 4, wherein the plurality of outer ribs define a square-like shape along a horizontal plane parallel with the first outer perimeter of the upper end of the wringer; and wherein the square-like shape has a perimeter that is larger than the first outer perimeter of the upper end.

8. The cleaning implement of claim 3, wherein the upper end is substantially conic-cylindrical and devoid of any drainage exits and the lower end is conical but not cylindrical and the lower end further comprising:

drainage exits located on each concave region, wherein the drainage exits are only located on a pinnacle location which is defined by the most distant area of the convex regions from the inner most portion of the concave regions; and wherein the plurality of convex regions define the plurality of concave regions, wherein there are least two opposing concave regions, and wherein the concave regions are positioned between adjacent convex regions.

9. The cleaning implement of claim 8, wherein for each convex region, no more than a single drainage exit is provided on any given horizontal plane.

* * * * *